United States Patent [19]

Brewer

[11] 3,950,678

[45] Apr. 13, 1976

[54] TIMELOCK FOR BANK VAULT DOORS AND THE LIKE

[76] Inventor: Kenyon Edwin Brewer, 75 Industrial St., San Francisco, Calif. 94124

[22] Filed: Feb. 14, 1975

[21] Appl. No.: 549,861

[52] U.S. Cl. ..... 317/134; 70/271; 340/274 C

[51] Int. Cl.[2] ..... H01H 47/00

[58] Field of Search ..... 317/134; 70/267–272; 340/274 C, 147 MD

[56] References Cited

UNITED STATES PATENTS

| | | | |
|---|---|---|---|
| 3,805,246 | 4/1974 | Colucci et al. | 317/134 X |
| 3,881,171 | 4/1975 | Moorman et al. | 70/271 X |

*Primary Examiner*—R. N. Envall, Jr.
*Attorney, Agent, or Firm*—Schapp and Hatch

[57] ABSTRACT

A timelock for bank vault doors and the like is disclosed. The disclosed timelock includes three electronic interval timing devices, each interval timing device including a bank of thumbwheel switches on which the desired minimum interval from the arming of the timelock to the reopening of the bank vault door or the like is retained from day to day unless manually changed. All three of the electronic interval timing devices are started by a switch operated by the timelock arming lever. Each electronic interval timing device includes a numerical display device on which the preset delay interval retained in its bank of thumbwheel switches is displayed. Each electronic interval timing device also includes a numerical display on which the unexpired delay duration is displayed in numerical form whenever that interval timing device is operating. Each electronic interval timing device also includes an output solenoid and means for energizing the output solenoid for a predetermined period (e.g., 15 seconds) commencing when the electronic interval timing device stops operating, having fully counted down. A standby battery system is provided for operating the timelock when line power is unavailable. When the timelock is operating on standby battery power the numerical display of each electronic interval timing device for displaying the unexpired delay duration of that device operates only when a push button on that device is depressed. When anyone of the three solenoids in the timelock is energized, its corresponding electronic interval timing device having counted down to zero, the G-strip of the timelock is so repositioned as to release the arming lever, thus withdrawing the snubber bar from the path of the snubber pin and permitting the bolts of the vault door to be operated into their unlocked position by the associated manual control.

14 Claims, 4 Drawing Figures

TIMELOCK FOR BANK VAULT DOORS AND THE LIKE

BACKGROUND OF THE INVENTION

1. Field of the Invention

The present invention relates to timelocks for bank vault doors and the like, and more particularly to timelocks of the kind adapted to be mounted on the inside of a bank vault door or the like to prevent the opening of the door by anyone outside the vault during selected delay intervals by blocking the path of movement of a snubber pin attached to the bolt bail.

2. Description of the Prior Art

Timelocks of this kind are well known in the prior art. Such prior art timelocks comprise three substantially identical clock movements, sometimes called "clocks," resembling highly refined kitchen timers, each of which is daily keywound and set by the user (e.g., a bank officer). Timelocks of this kind are generally provided with a manually operable arming knob or lever by means of which the user arms the timelock, i.e., prepares the timelock to block the path of movement of the snubber pin after the vault door is closed and locked, until at least one of the clocks fully runs down. When any one clock runs down in such prior art it displaces a longitudinally movable bar called the G-strip, thus releasing the arming lever to move from its operated state to its unoperated state and withdrawing the snubber bar from the path of movement of the snubber pin. When the path of movement of the snubber pin is thus unblocked it becomes possible to move the snubber pin, bolt bail and bolts by means of a hand wheel or the like and thus to unlock the vault door from outside the vault. The arming levers of timelocks of this kind are generally provided with lost-motion means which permit the arming lever to be manually returned to its unoperated state before the time set on any one of the three clocks runs out, whereby a person trapped in the vault may make it possible to effect his release from the vault by returning the arming lever to its unoperated position, whereafter a person outside the vault may release him by operating the combination lock and then operating the hand wheel or other bolt control means found on the outside of the vault door.

As is well known in the art, the space on the inside of typical bank vault doors for the mounting of timelocks is often stringently limited due to the presence of bolts, bolt bails, bolt actuating mechanisms, combination locks, and other mechanisms. Thus timelocks of this kind must in general be as compact as possible in order to permit mounting on the inside of many different vault doors without interfering with the operation of the other mechanisms just described. In addition, it is generally required by banking practice or law that three clocks be used in each timelock, in case of failure of one or two, and that each clock be capable of timing intervals as great as 120 to 144 hours. It follows necessarily that the daily setting of such prior art timelocks involves the winding of three clock-work mechanisms to precise settings on small, finely graduated dials, so finely graduated in some cases as to require the assistance of a built-in magnifying glass. Further since the clocks of such prior art timelocks are of the kind which run down to zero at the end of the interval set on the dial these clocks do not in general retain any indication of the magnitude of the previous time interval setting, though the same time interval setting may in fact be used from day to day, as in the weekday operation of banks. Yet further, the clocks of the prior art timelocks of this general kind begin to run down as soon as they are set.

Considering the above, it will be understood why in actual practice many instances have occurred in which, due to erroneous setting of prior art timelocks of this kind, it has been impossible to reopen the associated bank vault, necessitating the closing of the bank for an entire day or requiring that sufficient operating funds be procured from other banks at considerable cost in terms of additional security guards, armored transport, and the like.

SUMMARY OF THE INVENTION

Accordingly, it is an object of the present invention to provide a timelock for bank vault doors and the like which does not require the winding of three clock-work mechanisms to precise settings on finely graduated dials each time the timelock is set.

Another object of the present invention is to provide a timelock for bank vault doors and the like in which the preset delay interval before reopening of the vault is retained in each clock of the timelock from day to day.

A further object of the present invention is to provide a timelock for bank vault doors and the like in which the running of all three clocks is automatically commenced by the arming of the timelock and the individual clocks of the timelock do not commence running when set.

Yet another object of the present invention is to provide a timelock for bank vault doors and the like in which the preset delay interval retained in each clock of the timelock is displayed in the form of numerals of sufficiently large size to be easily readable even in conditions of reduced lighting.

A yet further object of the present invention is to provide a timelock for bank vault doors and the like in which the preset delay interval retained in each clock of the timelock, if inadvertently misset, can be immediately reset without waiting for the misset clock or clocks to run down.

An additional object of the present invention is to provide a timelock for bank vault doors and the like in which the unexpired delay duration is displayed in numerical form during the running down of each clock.

A still further object of the present invention is the provision of electronic clock means for timelocks of the abovedescribed kind, so constructed and arranged as to be substitutible for the mechanical clock-work mechanisms of existing timelocks without substantial alteration of the remaining mechanical parts of such existing timelocks.

Another object of the present invention is the provision of electronic clock means for use in timelocks of the above-described kind, which electronic clock means are normally operated by energy supplied from existing power lines, but which can be operated from standby batteries when line power is unavailable.

Yet another object of the present invention is to provide electronic clock means for timelocks of the kind described above capable of alternatively operating from line power or standby battery power and having illuminated numerical display means for displaying the unexpired delay duration of each clock as it runs down, the illuminated numerical display means being continuously illuminated during operation on line power and being unilluminated during operation on battery power except when a push button is depressed.

Other objects of the present invention will in part be obvious and will in part appear hereinafter.

The invention accordingly comprises the features of construction, combination of elements and arrangement of parts which will be exemplified in the construction hereafter set forth, and the scope of the invention will be indicated in the appended claims.

In accordance with one aspect of the present invention a timelock of the abovedescribed kind is provided with three electronic clocks, each electronic clock comprising a chain of three integrated circuit counters, three digital thumbwheel switches, one associated with each integrated circuit counter for predetermining the initial state at which that counter commences to count down, and three LED numerical display devices, one associated with each counter for displaying the numerical value corresponding to each state through which the counter passes as its integrated circuit counter chain counts down.

In accordance with another aspect of the present invention the mechanical structure of the lowest order thumbwheel switch of each of said electronic clocks is incapable of being set to zero.

In accordance with yet another feature of the present invention the three highest order integrated circuit counters of the timelock of the invention all commence to count down substantially simultaneously in response to a signal resulting from the closing of a switch mechanically coupled to the arming lever of the timelock, the down counting of each of said highest order integrated circuit counters commencing with the state of the counter corresponding to the setting of its associated thumbwheel switch.

In accordance with a further feature of the present invention each of said electronic clocks is provided with an output solenoid capable of displacing the G-strip of the timelock sufficiently to release the arming lever and permit the unlocking of the vault door when energized, and each of said electronic clocks comprises driver circuit means for energizing its associated output solenoid when its lowest order integrated circuit counter reaches its zero state, and for continuing to energize its associated output solenoid for a predetermined period of time, e.g., 15 seconds.

In accordance with yet another aspect of the present invention a timelock of the present invention includes a line power operated power supply and a rechargeable standby battery. This battery is constantly under float charge while line power is available, and thus is at all times ready for powering the timelock whenever line power becomes unavailable.

In accordance with a yet further aspect of the present invention automatic means is provided for extinguishing said LED numerical display means when line power becomes unavailable.

In accordance with an additional feature of the present invention a common oscillator is provided in each timelock of the present invention for driving the chain of three integrated circuit counters in each electronic clock, the rate of operation of the common oscillator being such that the countdown time in hours of the three-counter chain of any one of the electronic clocks is equal to the three digit number appearing on the indicators of the thumbwheel switch bank of that clock when the arming knob is depressed to initiate down counting.

In accordance with another feature of the present invention, a resetting of the thumbwheel switch bank of any electronic clock while that electronic clock is counting down does not change the countdown time of the clock unless the arming lever of the timelock is manually released and then fully depressed.

In accordance with a yet further feature of the present invention a common manual reset push button is provided in the timelock of the invention whereby the three-counter chains, one in each electronic clock, may be substantially simultaneously reset at any desired time for testing purposes.

For a fuller understanding of the nature and objects of the present invention reference should be had to the following detailed description taken in connection with the accompanying drawings.

DESCRIPTION OF THE PREFERRED EMBODIMENT

Figure 1:
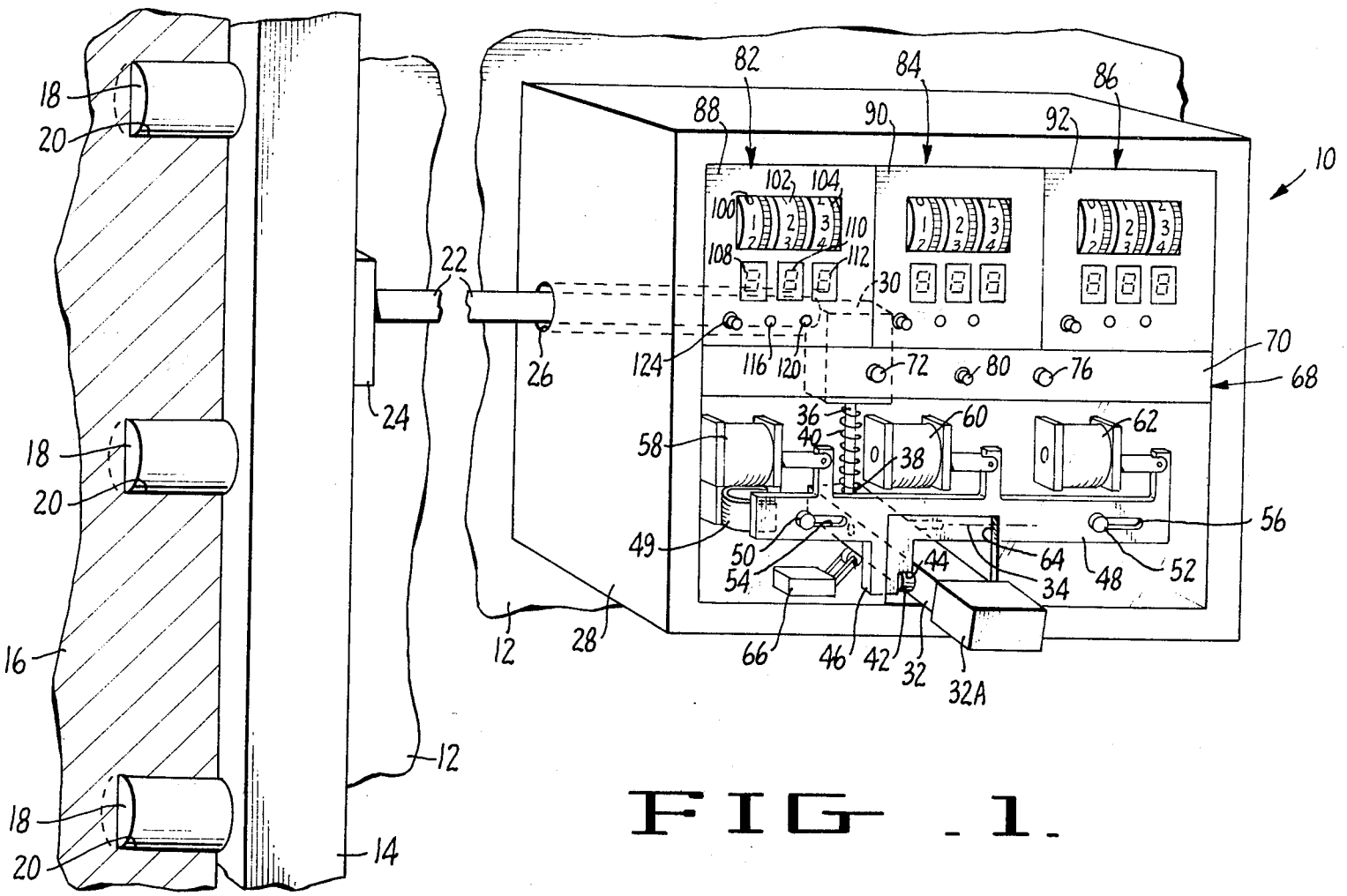
FIG. 1 is a perspective view, partially in phantom, of a timelock embodying the present invention.

Referring now to FIG. 1, there is shown a timelock 10 embodying the present invention, mounted in the door 12 of a bank vault or the like.

In the well known manner, vault door 12 is provided along each edge with a bolt bail 14. Each bolt bail 14 moves parallel to itself toward the door frame 16 when the locking wheel or handle (not shown) of vault door 12 is so manipulated as to lock vault door 12. Each bolt bail 14 is provided with a plurality of bolts 18, adapted to cooperate with corresponding recesses 20 in vault door frame 16 to lock vault door 12.

Also in the well known manner, a snubber pin 22 is attached to one of the bolt bails 14 of vault door 12 by well known intermediate means 24 (not shown in detail). Snubber pin 22 is aligned with and passes into a bore or similar guiding channel 26, which forms a part of the housing 28 of timelock 10.

When vault door 12 is locked as shown in FIG. 1 snubber pin 22 is so far withdrawn from bore 26 as to be clear of the vertical path of movement of a metal block or bar 30, called the snubber bar. When vault door 12 is locked snubber bar 30 is in its uppermost position (as shown in FIG. 1) in which position snubber bar 30 blocks bore 26, thereby preventing snubber pin 22 from entering more deeply into bore 26 than is shown in FIG. 1, and thus maintaining vault door 12 in its locked condition.

When snubber bar 30 is in its lower position (not shown) it is withdrawn from alignment with bore 26, thereby permitting snubber pin 22 to enter deeply into bore 26, and so permitting bolt bails 14 to be shifted parallel to themselves inwardly from the edges of door 12, withdrawing bolts 18 from recesses 20 and unlocking vault door 12.

When vault door 12 is locked, the position of snubber bar 30 is determined by the corresponding position of arming lever 32, which is itself pivoted about arming lever pivot axis 34 by well known means not shown.

When vault door 12 is locked and the user accessible front end 32A of arming lever 32 is in its downwardmost position, as shown in FIG. 1, snubber bar 30 is in its uppermost position, blocking bore 26 and preventing snubber pin 22 from entering more deeply therein than is shown in FIG. 1, so that bolt bail 14 is prevented from shifting to the right and withdrawing bolts 18 from recesses 20, and thus the unlocking of vault door 12 is prevented. Thus, it will be seen that bank vault door 12 can be unlocked when and only when snubber bar 30 is in its downwardmost position, substantially completely clear of bore 26. To so position snubber bar 30 the front end 32A of arming lever 32 must be raised to its uppermost position.

As is well known to those having skill in the bank vault door construction art, the individual bolt bails, or sometimes the individual bolts, of most vault doors are all mechanically intercoupled with the manually manipulable locking wheel or handle, and thus if one bolt is prevented from withdrawing from its associated recess in the vault door frame all of the bolts are prevented from withdrawing from their associated recesses. Thus, in general, only one snubber pin need be provided in order to control all of the bolts of a vault door.

As will also be evident from FIG. 1, the righthand end of snubber pin 22 will be positioned directly above snubber bar 30 whenever the locking wheel or handle of vault door 12 is so positioned that bolts 18 would be withdrawn from their corresponding door frame recesses 20 if door 12 were closed.

From this consideration it will also be understood that lost motion means must be provided in order to permit the front end 32A of arming lever 32 to be manipulated into its downwardmost or "armed" position when vault door 12 is in its unlocked condition, i.e., when bolt bails 14 are in their inwardmost position and snubber pin 22 is at its maximum depth in bore 26.

A particular lost motion means which may be employed in the timelock of the present invention is shown in FIG. 1. As there seen, snubber bar 30, which is mounted in a vertical guideway (not shown), is provided with a pivotably attached, downwardly depending pin 36, the lower end of pin 36 passing through a clearance slot 38 in arming lever 32 even when snubber bar 30 is in its upwardmost or "blocking" position and the forward end 32A of arming lever 32 is in its uppermost or "unarmed" position. As further seen in FIG. 1, snubber bar driving pin 36 is surrounded by a coil spring 40, which is affixed at its opposite ends to arming lever 32 and snubber bar 30. Coil spring 40 in its uncompressed state is slightly shorter than the distance between the lower surface of snubber bar 30 and the upper surface of arming lever 32 when snubber bar 30 is in its unblocking position and arming lever 32 is in its unarmed position. Thus, it will be seen that when snubber pin 22 is at its maximum depth in bore 26 and arming lever 32 is manipulated into its armed position (end 32A downward) coil spring 40 will be compressed and will resiliently bias snubber bar 30 upward against the lower surface of snubber pin 22. In this condition, timelock 10 is said to be "armed."

As may also be seen from FIG. 1, arming lever 32 is provided with a retaining pin 42 whereby it may be retained in its armed (downwardmost) position and thus timelock 10 may be kept in its armed condition or in its snubber pin lockout condition (FIG. 1).

Retaining pin 42 is preferably permanently affixed to the side of arming lever 32. Retaining pin 42 serves to maintain arming lever 32 in its armed (downwardmost) position when retaining pin 42 is engaged with a notch 44 in the lower end of a downwardly projecting arm 46 of a transversely slidable member 48 sometimes called in the art a G-strip. G-strip 48 is mounted for limited horizontal sliding by means of bolts 50, 52, which pass through close-fitting clearance clots 54, 56 in G-strip 48. Bolts 50, 52 are themselves affixed to a member or members which are immovably affixed to timelock housing 28, so that G-strip 48 is restricted to limited horizontal translation parallel to the lower face of housing 28. Referring again to FIG. 1, it can be seen that G-strip 48 is at the righthand extreme of its translatory motion whereat notch 44 of downwardly depending arm 46 engages retaining pin 42 thereby maintaining arming lever 32 in its armed position. As will also be seen from FIG. 1, the horizontal depth of notch 44 and the length of clearance slots 54, 56 are such that when G-strip 48 is moved to its leftwardmost position retaining pin 42 is released from notch 44 and arming lever 32 is permitted to tilt about axis 34 to its unarmed position under the urging of coil spring 40.

It will thus be seen that whenever G-strip 48 is translated to its leftmost position arming lever 32 is released to move to its unarmed position.

In accordance with the principles of the present invention, three solenoids 58, 60, 62 are provided for selectively pulling G-strip 48 into its leftmost position against the urging of restoring spring 49 and thus releasing arming lever 32 to return to its unarmed position. In some cases it may be found desirable to employ solenoids having their own restoring springs, rather than employing a single restoring spring associated with G-strip 48, and such alternative construction is within the scope of the present invention. The manner of energizing pull-in solenoids 58, 60, 62 will be described hereinafter in connection with the discussion of FIGS. 2 through 4.

Referring again to FIG. 1, it will be noted that the forward end 32A of arming lever 32 projects through opening 64 in the front face of timelock housing 28. It will be noted that there is considerable clearance between the righthand face of arming lever 32 and the righthand side of opening 64. By this means, and by the fact that the abovedescribed clearance slot 38 in arming lever 32 is sufficiently large compared with the diameter of pin 36, arming lever 32A can be manually forced rightwardly as seen in FIG. 1, thus releasing retaining pin 42 from notch 44 and permitting arming lever 32 to be raised to its unarmed position. By this means, it is possible for a person locked in a vault equipped with timelock 10 to thrust the forward end 32A of arming lever to the right and upward and thereby to draw snubber bar 30 downward completely out of alignment with bore 26. As explained hereinabove, when snubber bar 30 is drawn downward out of alignment with bore 26 snubber pin 22 is free to enter deeply into bore 26, and thus it becomes possible to immediately manipulate the locking lever or wheel of vault door 12 to withdraw bolts 18 from their recesses 20, whereupon the vault door can be opened.

Also shown in FIG. 1, is a switch 66 the moving contact of which is moved from its unoperated state to its operated state whenever snubber bar 30 is raised to its uppermost (blocking) position. The function of switch 66 in carrying out the present invention will be described hereinafter in connection with FIG. 2.

In addition to the mechanical components just described, timelock 10 also comprises a common electronic circuit sometimes herein called the power supply and designated by the reference numeral 68. The circuit components of the power supply are generally those indicated in FIG. 2 by well known electrical component symbols. The power supply circuit does not include the three like subcircuits indicated by rectangles at the righthand edge of FIG. 2. In the preferred embodiment the components of power supply 68 are mounted in a separate housing, which may itself, e.g., be mounted on the inside of the vault door.

Mounted on face panel 70 is a lens 72 covering an LED pilot light 74 (FIG. 2) and a second lens 76 covering an LED indicator lamp 78 (FIG. 2) the purpose of which will be explained hereinafter. Also mounted on face panel 70 is a push button switch 80 the purpose of which will be explained hereinafter.

Timelock 10 also comprises three substantially identical clock circuits 82, 84, 86. The principal part of each clock circuit is located directly behind its face panel in the upper part of timelock housing 28 (FIG. 1). Thus, the principal part of clock circuit 82 is located behind its face panel 88, located in the upper part of the front face of timelock housing 28 in FIG. 1. Similarly, the principal part of clock circuit 84 is located behind its face panel 90 (FIG. 1), and the principal part of clock circuit 86 is located behind its face panel 92 (FIG. 1). For clarity of exposition, it is considered that each clock circuit includes the solenoid located directly below it in FIG. 1. Thus, clock circuit 82 includes solenoid 58, clock circuit 84 includes solenoid 60, and clock circuit 86 includes solenoid 62.

Figure 2:
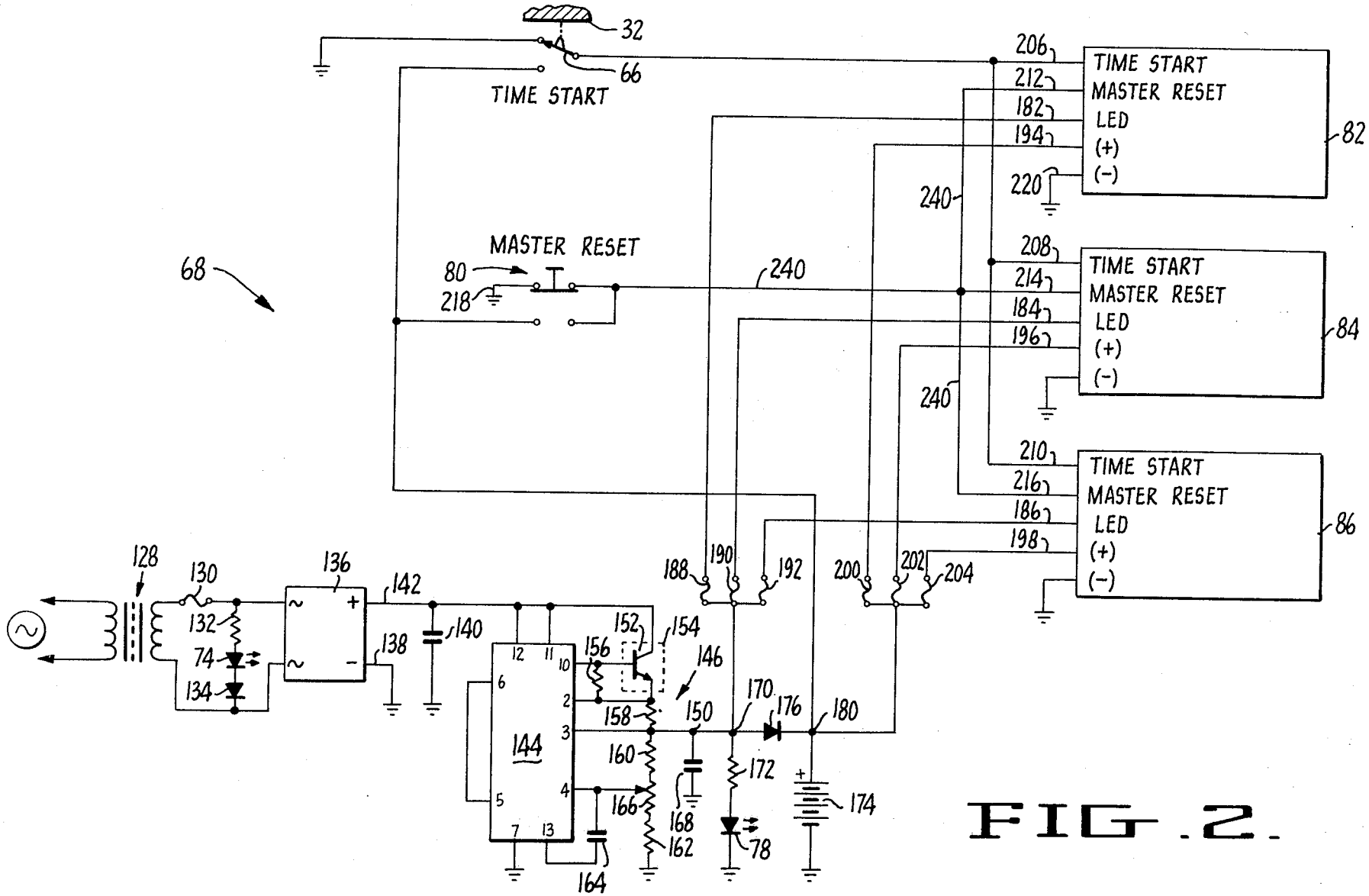
FIG. 2 is a schematic diagram of the circuit of the timelock of the present invention.

Going to FIG. 2, it will be seen that the three rectangles at the righthand edge thereof represent clock circuits 82, 84, and 86, respectively. Since, in accordance with the principles of the present invention, clock circuits 82, 84, and 86 are substantially identical, only one of these clock circuits, viz., clock circuit 82 is shown and described in detail herein. Thus, though only clock circuit 82 is shown in detail in FIGS. 3 and 4 and described in detail in connection therewith, it is to be understood that both of the other clock circuits 84, 86 are substantially identical to the circuit shown in FIGS. 3 and 4 and described in detail in connection therewith.

Returning to FIG. 1, it will be seen that face panels 88, 90 and 92 of clock circuits 82, 84 and 86 are substantially identical, including the various display and control means mounted thereon, and thus only panel 88 will now be described, it being understood that the display and control means mounted on panels 90 and 92 are substantially identical to those mounted on panel 88, and that the display and control means mounted on panels 90 and 92 coact with their associated clock circuit elements in the same manner in which the display and control means mounted on panel 88 coact with clock circuit 82.

Referring then, to face panel 88 as shown in FIG. 1, it will be seen that three digital thumbwheel switches 100, 102, 104 are mounted at the top thereof, so as to be accessible to an operator for resetting. Going to FIG. 4, it will be seen that the same digital thumbwheel switches 100, 102, and 104 are schematically represented at the top thereof.

Figure 4:
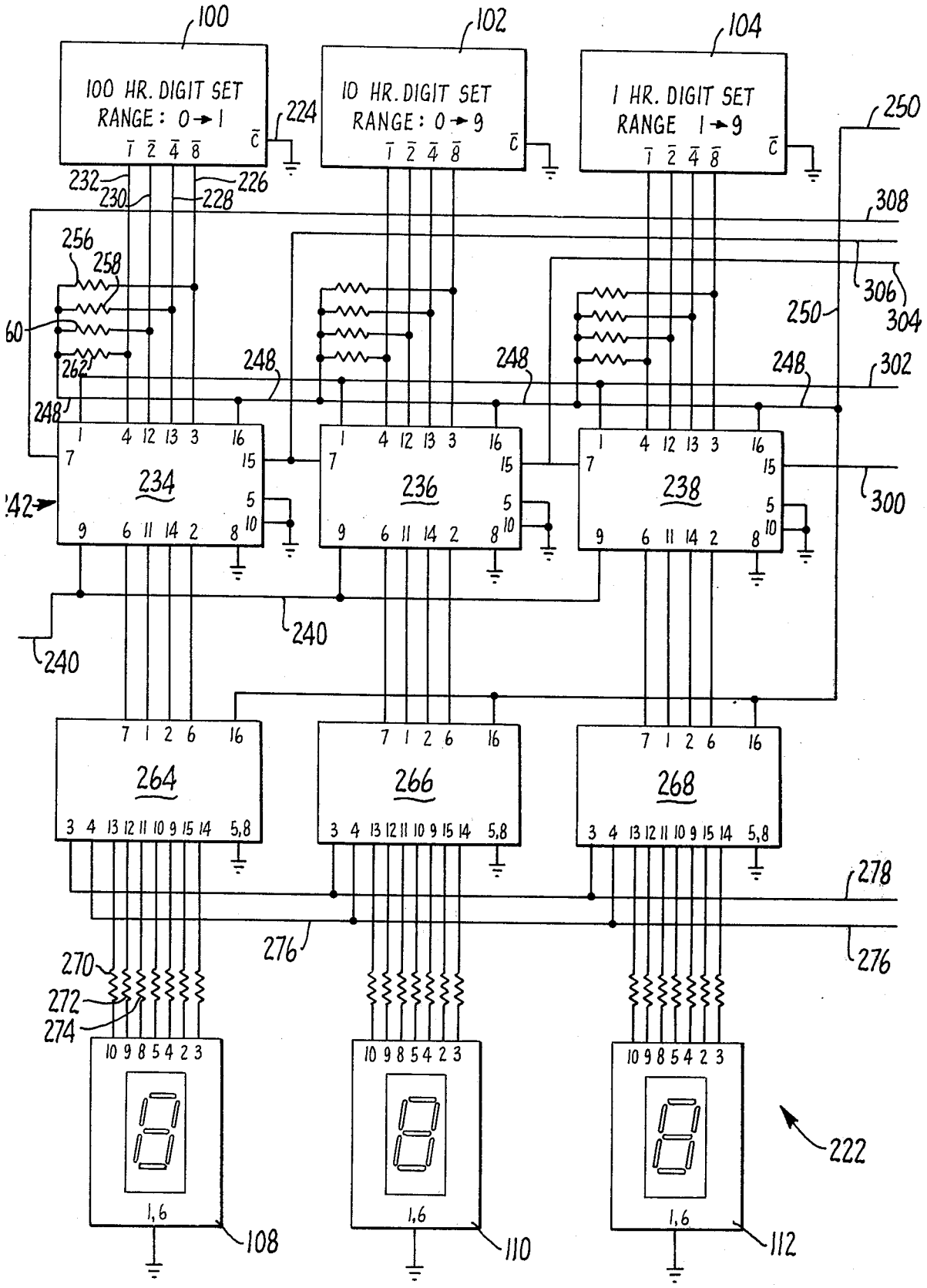
FIG. 4 is a schematic diagram of the counter and display circuit of one of the clock circuits of the timelock of the present invention.

Returning to FIG. 1, it will be seen that three LED single digit numerical display units 108, 110, 112 are located directly below thumbwheel switches 100, 102, and 104. Referring to FIG. 4, it will be seen that the LED single digit numerical display units 108, 110, and 112 are schematically represented at the bottom thereof.

Returning to FIG. 1, it will be seen that a lens 116 is located near the bottom of face panel 88 of clock circuit 82. Lens 116 covers and protects but passes light from a LED indicator 118 (FIG. 3), the purpose of which is to permit the user of the timelock of the invention to monitor the operation of the oscillator which drives the counter chain of clock circuit 82, as hereinafter described.

Figure 3:
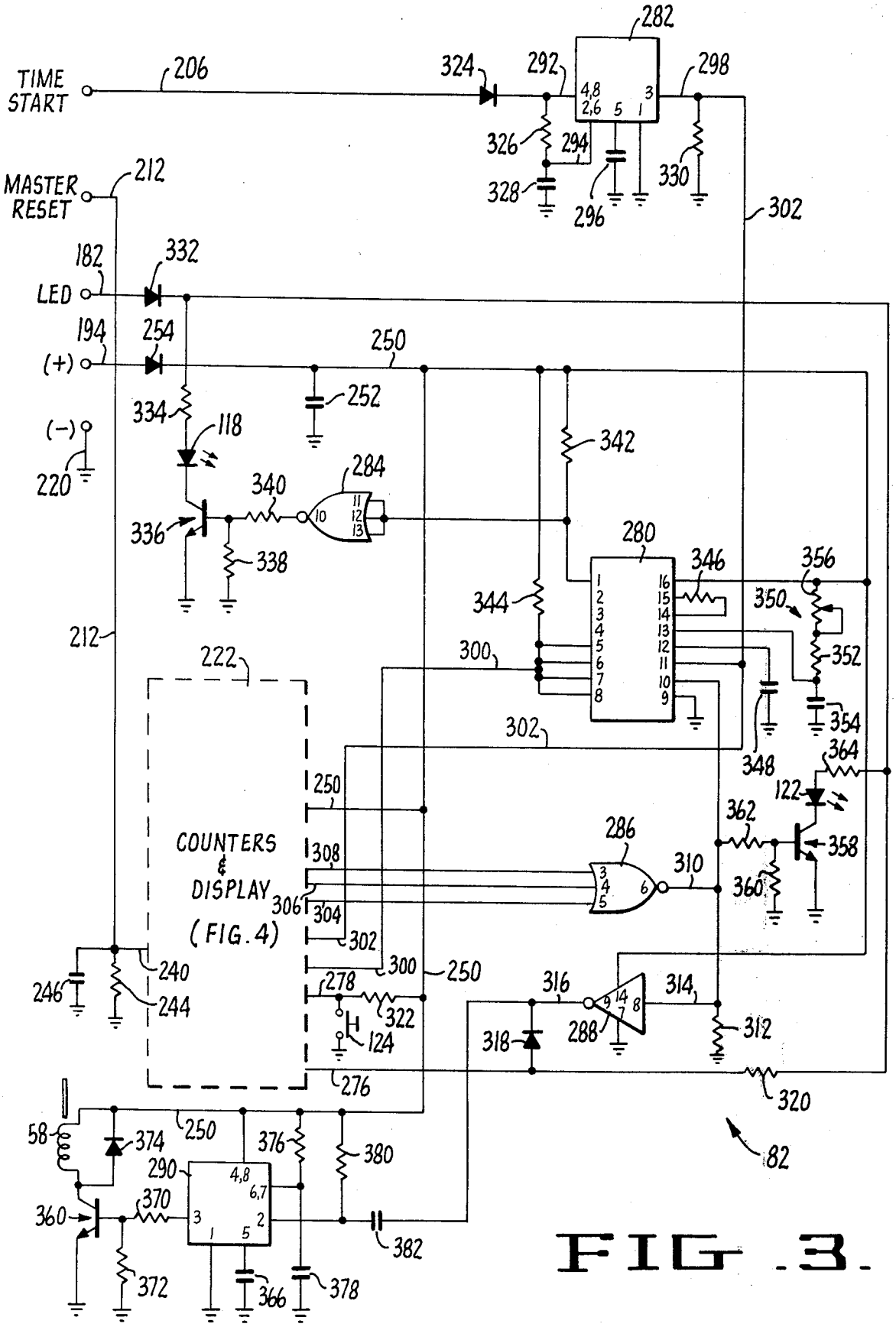
FIG. 3 is a schematic diagram of one of the clock circuits of the timelock of the present invention.

Returning to FIG. 1, it will be seen that a second lens 120 is located horizontally adjacent lens 116 on face panel 88 of clock circuit 82. Lens 120 covers and protects but passes light from a LED indicator 122 (FIG. 3). The purpose of LED indicator 122 is to provide an indication that clock circuit 82 has run down, i.e., is not in the process of counting down.

Returning to FIG. 1, it will also be seen that a push button switch 124 is mounted near the lower lefthand corner of face panel 88 of clock circuit 82. Push button switch 124 is also shown in FIG. 3. The purpose of push button switch 124 is to permit the user of timelock 10 to test LED numerical display units 108, 110 and 112. As explained hereinafter, clock circuit 82 is so constructed and arranged that whenever push button switch 124 is depressed, all of the segments of each of the LED numerical indicators 108, 110 and 112 will be illuminated, unless a LED numerical indicator or its associated converter and driver circuit is defective.

Referring to FIG. 2, there is shown that part of the circuit of timelock 10 which is herein referred to as power supply 68. The remainder of the circuit of timelock 10, viz., clock circuits 82, 84 and 86, is represented by three corresponding rectangles at the righthand edge of FIG. 2. Thus, FIG. 2 schematically represents the entire circuit of timelock 10, and power supply 68 constitutes that part of the circuit of timelock 10 which is not included in the three clock circuits. Going to the lefthand edge of FIG. 2, it will be seen that the primary winding of power transformer 128 is connected across a power line, e.g., a 120 volt alternating current power line. Power transformer 128 may, for instance, be a Stancor P6434 power transformer, having its secondary windings connected in parallel. In the preferred embodiment of a 6 ampere slow blow fuse 130 is connected in series with the secondary winding of power transformer 128. The abovedescribed LED pilot light 74 is connected in a series branch circuit across the secondary winding of power transformer 128 and fuse 130, said series branch circuit also including a 2,000 ohm, ½ watt, 10% resistor 132 and a 1N4001 diode 134. Connected across said series branch circuit, as shown in FIG. 2, is a solid-state bridge rectifier 136 having a substantial heat sink and a current rating of about 6 amperes, such as a Varo VH-248 bridge rectifier or its equivalent. As also shown in FIG. 2, the negative of the terminal 138 of bridge rectifier 136 is grounded and a capacitor 140 is connected directly between negative terminal 138 and the corresponding positive terminal 142 through ground. Capacitor 140 may, for instance, be a 3,000 microfarad capacitor rated at 35 volts.

Also connected across the direct current terminals of rectifier 136 is a voltage regulator 144, such as a Fairchild $\mu$A723 integrated circuit voltage regulator. Pins 5 and 6 of voltage regulator 144 are directly connected by means of a shunt connection, as shown in FIG. 2. As will also be evident from FIG. 2, pins 11 and 12 of voltage regulator 144 are connected directly to positive terminal 142 of rectifier 136, while pin 7 of voltage regulator 144 is grounded.

As also seen in FIG. 2, a network 146 is connected across pins 2, 3, 4, 10, 11 and 13 of voltage regulator chip 144 for the purpose of supplying variable magnitude direct current voltage at output point 150, and for handling higher current than regulator chip 144 is capable of handling, while at the same time the variable magnitude direct current voltage produced at point 150 is well regulated under the control of the output of voltage regulator chip 144.

The active element of network 146 is a transistor 152, e.g., a 2N3055 transistor mounted on a heat sink 154. As seen in FIG. 2, a resistor 156 is connected between the base and the emitter of transistor 152, resistor 156 being, for instance, a 10,000 ohm, ½ watt, 10% resistor. Resistor 156 is connected between pins 2 and 10 of voltage regulator chip 144.

Network 146 further comprises fixed resistors 158, 160 and 162, and a capacitor 164, all connected as shown in FIG. 2. Resistor 160 may, for instance, be a 2,200 ohm, ½ watt, 10% resistor, and resistor 162 may, for instance, be a 2,700 ohm, ½ watt, 10% resistor. Resistor 158 may be a 0.12 ohm, 5 watt, 10% resistor.

Capacitor 164 may be, for example, a 500 picofarad capacitor.

Network 146 also comprises a variable potentiometer 166 by means of which the magnitude of the direct current voltage produced at point 150 may be manually adjusted. Potentiometer 166 may, for instance, be a Spectrol No. 43P-102 1000 ohm potentiometer.

In order to reduce any ripple component which otherwise would be present in the direct current voltage appearing at the upper terminal of resistor 160, a capacitor 168 is provided between output voltage point 150 and ground. Capacitor 168 may, for instance, be a 1,000 microfarad capacitor, rated at 35 volts.

From the above it will be seen that direct current supply point 170 of FIG. 2 is provided with regulated, adjustable direct current voltage in the preferred embodiment of the present invention.

As further seen in FIG. 2, LED pilot light 78 is connected in series with a resistor 172 between direct current aupply point 170 and ground. LED pilot light 78, by its state of illumination, and by comparison with LED pilot light 74, indicates whether the rectifier and regulator circuit, 136, 144, 146, etc., is functioning. Resistor 172 may, for example, be a 1,200 ohm, ½ watt, 10% resistor.

As will also be evident to those having ordinary skill in the art from FIG. 2 and the accompanying text, a rechargeable battery 174 is charged from direct current supply point 170 through a diode 176. Rechargeable battery 174 may, for instance, be a Globe Gel/Cell GC-1245-1 rated at 12 volts and 4.5 ampere hours. Diode 176 may be an MR752 diode, rated at 6 amperes.

As seen in FIG. 2, blocking diode 176 is connected between positive direct current supply point 170 and the positive terminal 180 of battery 174, and is poled for current flow from point 170, but not toward it.

As also seen in FIG. 2, positive direct current voltage is supplied to the positive LED terminals 182, 184 and 186 of clock circuits 82, 84 and 86 from direct current supply point 170 through fuses 188, 190 and 192.

The other positive terminals of clock circuits 82, 84 and 86, on the other hand, are supplied with positive direct current voltage from positive battery terminal 180.

Referring to FIG. 2, it will be seen that the plus-marked terminals 194, 196 and 198 of clock circuits 82, 84 and 86 are connected directly to positive terminal 180 of battery 174 through fuses 200, 202 and 204. It will also be seen in FIG. 2 that the time start terminals 206, 208 and 210 of clock circuits 82, 84 and 86 are connected to positive battery terminal 180 through time start switch 66, and that the master reset terminals 212, 214, and 216 of time clocks 82, 84 and 86 are connected to positive battery terminal 180 through master reset switch 80.

Examining these interconnections as shown in FIG. 2, then, and considering the polarity of blocking diode 176, it will be seen that the time start, master reset, and plus-marked terminals of clock circuits 82, 84 and 86 are supplied with positive direct current voltage at all times; from output point 150 when line voltage is available, and from battery 174 when it is not.

By contrast, due to the blocking action of blocking diode 176, the LED terminals 182, 184 and 186 of clock circuits 82, 84 and 86 are impressed with direct current voltage from supply point 170 only when the device of the present embodiment is receiving alternating current voltage from the supply line and the rectifying and regulating network is operating correctly.

Thus, it can be seen that in the device of the preferred embodiment blocking diode 176 serves to assure that when power from the power line is unavailable the LED terminals 182, 184 and 186 of the clock circuits are not excited. As described hereinbelow, the LED numerical display units of the three clock circuits, e.g., 108, 110, 112, FIG. 1, are energized from the LED terminals 182, 184, 186 and thus, due to the blocking action of blocking diode 176, the LED numerical display units of the three clock circuits will be unilluminated unless power is available from the power supply line connected to transformer 128 (FIG. 2).

On the other hand, the other positive terminals of the clock circuits, i.e., 194, 196, 198, 206, 208, 210, will be excited with direct current from the positive terminal 180 of battery 174 so long as line voltage is available, provided only that fuses 200, 202, and 204 are not blown.

In the preferred embodiment shown and described, LED pilot light 78 may, for instance, be an MLED750, resistor 172 may be a 1200 ohm, ½ watt, 10% resistor, and blocking diode 176 may be an MR752, rated at 6 amps. Similarly, and also by way of example only and not by way of limitation, fuses 188, 190 and 192 may be ½ amp. rated fuses, and fuses 200, 202 and 204 may be 2 amp. rated fuses. Further, also by way of example only, master reset switch 80 may be a C and K P8121 push button switch, normally closed through its ground terminal 218, and time start switch 66, operated by arming lever 32 as described in connection with FIG. 1 above, may be a MICROSWITCH V3-101.

Going now to FIGS. 3 and 4, which taken together illustrate a single clock circuit 82, the other two clock circuits 84 and 86 being presumed to be substantially identical, the construction of the clock circuits of the preferred embodiment of the present invention will now be described.

Referring first to FIG. 3, it will be seen that the circuit shown in FIG. 3 comprises two parts, i.e., the circuit structure shown specifically in FIG. 3 and the circuit structure of FIG. 4 comprising the counters and display units, represented by a dashed line rectangled 222 in FIG. 3.

For easier comprehension of the part of clock circuit 82 shown in FIG. 3, the counter and display circuitry represented by dashed line rectangle 222 in FIG. 3 will first be described in connection with FIG. 4.

Going now to FIG. 4 and comparing it with FIG. 1, it will be seen that three rectangles 100, 102 and 104, representing the digital thumbwheel switches 100, 102 and 104 described hereinabove in connection with FIG. 1, are arranged across the top of FIG. 4. Switches 100, 102, and 104, may, for example, each be a one order EECoswitch No. 177612G with complement outputs only, such switches being more specifically designated in the manufacturer's catalog as BCD 1-2-4-8 complement only switches. Further, each of these switches 100, 102, 104 is limited in its range of decimal settings by internal stops preset by the manufacturer. Thus, digital thumbwheel switch 100 is internally mechanically limited to the decimal settings 0 and 1; digital thumbwheel switch 102 can be set to any decimal digit from 0 through 9; and digital thumbwheel switch 104 can be set to any decimal digit but 0.

Each such digital thumbwheel switch 100, 102, 104 is provided with one common terminal (labeled C in FIG. 4) and four BCD output terminals (numbered 1, 2, 4 and 8 in FIG. 4). Thus, digital thumbwheel switch 100 in FIG. 4 has a common terminal 224, a BCD terminal 226 of weight 8, a BCD terminal 228 of weight 4, a BCD terminal 230 of weight 2, and a BCD terminal 232 of weight 1.

Considering digital thumbwheel switch 102, which has a full range and thus is settable to any decimal digit from 0 to 9, it will be understood that when thumbwheel switch 102 is manually set to indicate decimal digit 2, its 1, 4 and 8 terminals will be connected to ground through its C terminal, and only its 2 terminal will be disconnected from ground. Similarly, when digital thumbwheel switch 102 is manually set to indicate the decimal number 5, its 2 and 8 terminals will be internally electrically connected to common terminal C and thus to ground, while its 1 and 4 terminals will be unconnected to ground internally of switch 102.

As further seen in FIG. 4, each of the digital thumbwheel switches 100, 102 and 104 has an associated element 234, 236, 238. Each of these elements 234, 236, 238 is a counter circuit of the type sometimes called a BCD down counter. The BCD counters used in the preferred embodiment may, for instance, be Motorola MC14510 integrated circuit counters. The pin numbers given just inside the recangles 234, 236 and 238 designate the corresponding pins of such an MC14510 counter as used in the present embodiment.

The internal structure of integrated circuit counters 234, 236 and 238, like that of the corresponding counters in clock circuits 84 and 86, is such that when a 12 volt positive-going pulse is impressed upon their terminal pins 9 via signal line 240, they are all reset to their 000 state.

Further, the internal structure of all of these counters is such that when their 1-pins experience positive-going pulses of sufficient magnitude, each counter is set to the internal state corresponding to the pattern of voltages then appearing on its pins 3, 4, 12 and 13, which is in turn determined by the setting of its associated thumbwheel switch. Thus, when thumbwheel switch 102 is set to show decimal 6 and a suitable positive-going pulse appears on the 1-pin of counter 236, counter 236 assumes its decimal 6 representing internal state.

As may further be seen in FIG. 4, counters 234, 236 and 238 are connected as a counter chain by means of direct connections extending from pin 7 of counter 238 to pin 15 of counter 236 and from pin 7 of counter to pin 15 of counter 234. Thus, counters 234, 236 and 238 from a three-stage counter chain, designated herein by the reference numeral 242, counter 238 being the low order counter, and counter 234 being the high order counter of counter chain 242.

It will be understood by those having ordinary skill in the art, given the above-supplied knowledge of the kind of counter employed as counters 234, 236 and 238, that successive positive pulses received upon pin 15 of low order counter 238 will cause the entire counter chain to count downward. A positive-going pulse received on pin 15 of counter 238 immediately after counter chain 242 has been set by a positive-going pulse upon all three pins 1 to its state corresponding to the respective settings of switches 100, 102 and 104 will cause counter chain 242 to count downwards by a count of one, whereafter its state will correspond to the setting on thumbwheel switches 100, 102 and 104, less decimal one. A second positive-going pulse received at pin 15 of counter 238 will cause the counter chain 242 to count down by unity once more, whereafter it will be in its state corresponding to the decimal number shown upon the three digital thumbwheel switches 100, 102 and 104 less the decimal number two. A third pulse received at pin 15 of counter 238 will, assuming the same bias conditions to continue to obtain, result in counter chain 242 once more counting down by one, whereafter its state will be representative of the decimal number set upon thumbwheel switches 100, 102 and 104, less the decimal number three.

As will now be evident to those having ordinary skill in the art informed by the present disclosure, each successive pulse received at pin 15 of counter 238, assuming that the bias conditions remain the same, will alter the state of counter chain 242 so that the decimal number corresponding to its new state will be one decimal number less than the decimal number corresponding to its state before the receipt of that pulse.

In order to achieve the correct biasing conditions for such down counting operation of counter chain 242, the following circuit interconnections are provided, all as shown in the instant drawings.

It is to be understood, of course, that while the appropriate circuit interconnections for counter chain 242 of clock circuit 82 are here described, substantially identical circuit interconnections must be provided for proper down counting operation of the counter chains of clock circuits 84 and 86.

As seen in FIGS. 4, the 5, 8 and 10 pins of each of the counters 234, 236 and 238 are grounded.

Further, all of the 9-pins of the counters 234, 236 and 238 are connected to ground through master reset switch 80, (FIG. 2), which is undepressed and thus normally closed to ground during the down counting of counter chain 242, as will be seen by tracing common reset signal line 240 to FIG. 3 and thence via master reset terminal 212 to FIG. 2. The pulse shaping network shown in FIG. 3, comprising resistor 244 and capacitor 246, is shunted by master reset switch 80 when that switch is in its normal grounded, i.e., unoperated, state, and thus the pulse-shaping network 244, 246 has no effect on the down counting operation of counter chains 242. In the preferred embodiment shown and described herein resistor 244 may, unless switch 80 is operated, be a 27,000 ohm, ¼ watt, 10% resistor, and capacitor 246 may be a 5 microfarad capacitor rated at 25 volts DC.

During the down counting of counter chain 242 the 1-pins of counters 234, 236 and 238 will be maintained substantially at ground potential, as hereinafter described in connection with FIG. 3.

During down counting of counter chain 242 the 4, 12, 13 and 3 pins of each counter 234, 236 and 238 will be maintained either close to ground or close to a direct current potential of 12 volts, depending on the setting of the thumbwheel switch associated with each counter. A common 12 volt supply line 248 is provided, which is connected at one of its ends to a 12 volt buss 250. As seen in FIG. 3, buss 250 is connected to ground through a capacitor 252 and thence through diode 254 to the plus-marked terminal 194 of clock 82 (FIG. 2). The functions of capacitor 252 and diode 254 will be apparent to those having ordinary skill in the art, and in the preferred embodiment capacitor 252 may be a 10 microfarad capacitor and diode 254 may be an MR502 diode rated at 3 amps.

Returning to FIG. 4, it will be seen that each interconnecting line between a non-common terminal of one of the thumbwheel switches 100, 102, 104 and the corresponding pin 3, 4, 12 or 13 of its corresponding counter has connected to it one terminal of a resistor. E.G., one terminal of resistor 256 is connected to the line 226 between the 8-terminal of thumbwheel switch 100 and the 3-pin of counter 234; one terminal of resistor 258 is connected to the line 228 between the 4-terminal of thumbwheel switch 100 and its corresponding 13-pin of counter 234; etc. As will be evident from consideration of the present specification and drawings, four of such pull-up resistors are similarly connected to the 3, 4, 12 and 13-pins of each of the nine counters of the three clock circuits of the timelock of the preferred embodiment of the present invention.

Returning to FIG. 4, and recalling the above description of thumbwheel switches 100, 102, and 104, it will be seen that the 3, 4, 12 and 13-pins of all three counters 234, 236 and 238 are each in one of two states, viz., either grounded through the associated thumbwheel switch 100, 102, 104, or at approximately 12 volts positive (direct current).

Referring again to FIG. 4, it will be seen that the 16-pins of all three counters 234, 236 and 238 are directly connected to common supply line 248, and thus remain at approximately 12 volts.

As further shown in FIG. 4, each counter 234, 236, 238 has associated with it a corresponding circuit element 264, 266, 268.

Circuit elements 264, 266 and 268 of FIG. 4 are substantially identical, each being an integrated circuit of the type sometimes called a BCD-to-Seven Segment Decoder/Driver. A particular integrated BCD-to-Seven Segment Decoder/Driver circuit which may be used in the preferred embodiment of the present invention is the Motorola MC14511. Each driver circuit 264, 266, 268 is connected to a corresponding LED numerical indicator 108, 110, 112 described hereinabove. The pin interconnections between each counter, its associated driver, and the LED numerical indicator associated therewith are indicated in FIG. 4, and will not be described in detail, except to note that all seven of the current limiting resistors 270, 272, 274, etc., associated with each LED numerical indicator, 108, 110, 112 is of substantially the same resistance value, viz., 1,200 ohms, and that all of these current limiting resistors are rated at ½ watt, and are of 10% tolerance value. As will be evident from FIG. 4, the 16-pins of all three drivers 264, 266 and 268 are connected to 12 volt direct current supply line 250 described hereinabove. Also, as shown in FIG. 4, the 5-pin and the 8-pin of each driver are grounded. Simmilarly, the 1-pin and the 6-pin of each LED numerical indicator 108, 110 and 112 is grounded.

Driving current for each LED numerical indicator 108, 110, 112 is provided through its associated driver circuit, and is supplied to the associated driver circuit through the 16-pin of that circuit.

The structure and mutual cooperation of each driver and its associated numerical LED indicator is such that when the 3-pin of the driver is grounded operating voltage for the LED indicators then being supplied via the 16-pins of the drivers, all seven segments of the indicator will be illuminated. A common line 278 is provided whereby the 3-pins of all three drivers 264, 266 and 268 may be simultaneously grounded for test purposes, as explained hereafter in connection with FIG. 3.

Referring now to FIG. 3, it will be seen that the portion of clock circuit 82 shown therein comprises, in addition to the abovedescribed circuit of FIG. 4, which is represented in FIG. 3 by dashed-line rectangle 222, the following subcircuits or major circuit elements: A counter chain driver or time base generator 280, which may, for example, be an Exar XR-2240 or XR-2340 integrated circuit time base generator. A pulse generator 282 which may, for example, be a Signetics 555 delay pulse generator. A gate circuit 282, used as an inverter-amplifier, which may, for example, be one of the two three-input NOR gates of Motorola MC14000 integrated circuit, called by the manufacturer a DUAL 3-INPUT "NOR" GATE PLUS INVERTER. A gate circuit 286, which may also be one of the NOR gates of said Motorola MC14000 integrated circuit. A logic level changer circuit 288, which may be the inverter of said Motorola MC14000 integrated gate circuit. A pulse generator circuit 290, which may, for example, be a Signetics 555 delay pulse generator.

Whenever a subcircuit or major circuit element is shown in the present drawings by a rectangle or a conventional subcircuit-representing shape or outline, and a plurality of numerals are found immediately within the periphery of that rectangle, shape, or outline adjacent terminals or leads emanating from the rectangle, shape, or outline, it is to be understood that those numerals represent the pin or terminal connections of the commercially available subcircuit or circuit element suggested in the present specification as usable in the place of that rectangle, outline or shape.

Thus, if the suggested Signetics 555 delay pulse generator is used for subcircuit 282 (FIG. 3), its 4-pin and 8-pin will both be connected to line 292 (FIG. 3). Similarly its 2-pin and its 6-pin will both be connected to line 294, its 5-pin will be connected to the ungrounded terminal of capacitor 296, its 1-pin will be grounded, and its 3-pin will be connected to line 298.

Comparing FIGS. 3 and 4, it will be seen that for ease in tracing the leads shown in FIG. 3 which terminate at dashed-line rectangle 222 into FIG. 4, the reference numeral corresponding to each such terminating lead is supplied near the border of rectangle 222 and the same reference numeral is appended to the same lead where it commences at the border of FIG. 4.

Thus, counter chain reset pulse line 240 is identified by that reference numeral immediately outside rectangle 222 in FIG. 3 and is also identified by that reference numeral immediately inside the lefthand border of FIG. 4. Likewise, the 12 volt direct current supply line 250 is identified by that reference numeral immediately outside rectangle 222 in FIG. 3 and is also identified by that reference numeral immediately inside the border of FIG. 4. Comparison of FIGS. 3 and 4 will further show that the same practice is adopted with respect to display blanking control line 276, display test line 278, counter chain pulsing line 300, counter chain presetting enable setting pulse line 302, and the three counter zero signal lines 304, 306 and 308.

Considering first counter chain reset pulse line 240 as shown in FIG. 3, it will be seen that this line is directly connected to the above-ground terminals of resistor 244 and capacitor 246, and to line 212.

Going to FIG. 2, it will be seen that line 212 is so connected to master reset switch 80 as to be grounded when switch 80 is undepressed, and to be connected to the positive terminal of the direct current supply whenever switch 80 is depressed.

As will be understood by those having ordinary skill in the art, the sudden occurrence of a 12 volt direct current potential on line 212 (FIG. 3) whenever master reset switch 80 is depressed results in the production of a positive-going pulse on line 240 (FIG. 3) due to the well known action of the RC network consisting of resistor 244 and capacitor 246.

Tracing line 240 to FIG. 4, it will be seen that line 240 is connected to the 9-pin of each of the counters 234, 236 and 238.

As pointed out hereinabove, when a 12 volt positive-going pulse is impressed on these 9 pins, the three counters 234, 236 and 238 are all reset to their 000 state. Thus, it follows that depression of switch 80 at any time will reset the counters of clock circuit 82 to their zero state.

As can be seen from the interconnections between master reset switch 80 and the master reset terminals 214 and 216 of clock circuits 84 and 86 (FIG. 2) and from the fact that as explained hereinabove the clock circuits 84 and 86 are substantially identical to clock circuit 82, the counters of clock circuits 84 and 86 will also be reset to their zero state whenever master reset switch 80 is depressed.

As explained hereinabove, 12 volt direct current supply line 250 carries approximately 12 volts direct current (positive) from supply point 150, unless line voltage becomes unavailable, in which case it is supplied from battery 174 (FIG. 2). In either case, line 250 is excited by way of plus-marked terminal 194 and the interconnections shown in FIG. 2. Going to FIG. 4, then, it will be seen that supply line 250 provides a positive bias potential of approximately 12 volts direct current to the counters 234, 236 and 238 and the drivers 264, 266 and 268, even when line voltage becomes unavailable.

The counter and driver subcircuits of clock circuits 84 and 86 are similarly supplied with approximately 12 volts positive direct current bias potential.

Referring to FIG. 3, it will be seen that each of the three counter zero signal lines 304, 306 and 308 is connected to NOR gate 286 as a logical input. Further, as seen in FIG. 4, each of the counter zero signal lines 304, 306 and 308 is connected at one of its ends to a 7-pin of a corresponding one of the counters 234, 236 and 238. Further, as pointed out hereinabove, each of the counters 234, 236 and 238 is a Motorola MC14510 integrated circuit counter. As can be determined from the literature describing these counters which is well known to those having ordinary skill in the art, the 7-pin of each of these counters is at ground when the counter is in its zero state.

It follows that whenever counter chain 242 is in its 000 state, all three inputs to NOR gate 286 are grounded.

Thus, due to the well known properties of NOR gates, output terminal 310 of NOR gate 286 will be at system 1 (logical one) level, i.e., 12 volts positive (direct current) whenever counter chain 242 is in its 000 state.

This being so, the resulting current through resistor 312 will cause such a voltage drop thereacross as to drive the input terminal 314 of inverter 288 to approximately 12 volts positive (direct current). In accordance with the well known characteristics of inverters, then, the output terminal 316 of inverter 288 will be close to ground. This being so, the cathode of diode 318 will be grounded.

As may be seen by comparing FIGS. 2 and 3, however, the anode of diode 318 is connected to direct current supply point 170 (FIG. 2) through the resistor 320 shown in the lower right-hand corner of FIG. 3.

If the resistance value of resistor 320 is considerably higher than the equivalent resistance of diode 318, which is the case in the preferred embodiment, then the anode of diode 318 goes substantially to ground whenever output terminal 316 of NOR gate 288 is grounded, i.e., whenever counter chain 248 is in its 000 state.

Referring again to FIG. 3, it will be seen that the display blanking control line 276 is directly connected to the anode of diode 318. It follows, then, that display blanking control line 276 will be grounded when counter chain 242 (FIG. 4) is in its 000 state.

Consulting FIG. 4, it will be seen that display blanking control line 276 is connected to the 4-pins of all three display drivers 264, 266 and 268.

Since the particular driver circuits 264, 266 and 268 used in the preferred embodiment are of the Motorola MC14511 type, it is known to those having ordinary skill in the art that grounding their 4-pins will blank their corresponding displays, i.e., 108, 110 and 112.

It follows from the above, then, that is the preferred embodiment of the present invention numerical display indicators 108, 110 and 112 are blanked whenever their corresponding counter chain 242 is in its 000 state.

Since, as pointed out hereinabove, clock circuits 84 and 86 are substantially identical to clock circuit 82, it follows that the numerical display indicators of clock circuits 84 and 86 are also blanked whenever the counter chains of clocks 84 and 86 are in their 000 state.

In the preferred embodiment shown and described herein resistor 312 may be an 18,000 ohm, ¼ watt, 10% tolerance resistor; diode 318 may be a 1N4001 solid state diode, and resistor 320 may be an 18,000 ohm, ¼ watt, 10% tolerance resistor.

As will be evident from the immediately preceding discussion, then, it is a characteristic feature of the present invention that whenever the counter chain of one of its clock circuits "runs down," the three numerical display indicators of that clock circuit are blanked, i.e., are no longer illuminated, as they are when the counter chain of that clock circuit is in the process of counting down. By this means, considerable current drain is avoided. At the same time, i.e., during the fully run down condition of any one of the counter chains, its associated LED indicator (e.g., 122 in clock circuit 82) remains illuminated in order to provide a continuous indication of the state of operation of that clock circuit. It is to be understood, however, that it is within the scope of the present invention to eliminate diode 318 (FIG. 3), in which case the LED numerical display indicators of each clock circuit will read 000 whenever its counter chain is run down.

Going to FIG. 3, it will be seen that the display test line 278 is connected to ground through the display test push button switch 124. It will also be seen that a resistor is connected between display test line 278 and 12 volt direct current supply line 250. By way of example, resistor 322 is, in the preferred embodiment, an 18,000 ohm, ¼ watt, 10% tolerance resistor.

As will be obvious to those having ordinary skill in the art, then, display test line 278 will normally be at the potential of line 250, i.e., 12 volts positive (direct current), except when display test switch 124 is closed (depressed), when display test line 278 will be at ground.

As will be clear from tracing display test line 278 into FIG. 4, the 3-pins of all of the drivers 264, 266 and 268 will be grounded when display test line 278 is grounded, i.e., when display test switch 124 is depressed.

As pointed out above, however, the grounding of the 3-pin of any of the driver circuits 264, 266, 268 when the display operating voltage is supplied to their 16-pins, causes all seven segments of the associated numerical display indicator to be illuminated.

Thus, since the 3-pins of all three drivers are connected to display test line 278, depressing the display test push button switch 124 (FIG. 3) will cause all seven segments of all three numerical display indicators 108, 110, 112 to be illuminated, except when a malfunction condition of one of the numerical display indicators or its associated driver circuit exists.

Thus, it is a feature of the present invention that the clock circuits of the timelock of the invention are so constructed and arranged, as described immediately above, that all of the numerical display indicators of any one of the clock circuits may be immediately tested by simply depressing an associated push button and noting whether all of the segments of all of the associated numerical display indicators are illuminated.

As will be evident from the tracing of counter chain pulsing line 300 from pin 15 of "units" counter 238 (FIG. 4) to the common connection of the 5, 6, 7 and 8-pins of time base generator 280 (FIG. 3), counter chain pulsing line 300 serves to convey the down counting pulses from time base generator 280 to the driving pulse input terminal of counter chain 242 (FIG. 4).

As may also be seen by comparing FIG. 3 and 4, counter chain setting pulse line 302 connects the output terminal 298 of delay pulse generator 282 to the 1-pin of counters 234, 236 and 238.

As pointed out above, the structure of these counters is such that when their 1-pins experience positive-going voltage pulses of sufficient magnitude, each counter is set to the internal state corresponding to the setting of its associated thumbwheel switch 101, 102, 104.

It will be seen, then, that when the counter chain setting (or preset enable) pulse line 302 carries a positive-going pulse from delay pulse generator 282 to the 1-pins of counters 234, 236 and 238, counter chain 242 is immediately set to the state determined by the existing settings of the thumbwheel switches, 100, 102 and 104.

Before describing the overall operation of the device of the embodiment of the present invention shown and described herein, the values of certain particular circuit components shown in FIG. 3 will be given, for completeness of disclosure.

Diode 324 at the input of delay pulse generator 282 is a 1N4001 solid state diode. The resistor 326, connected between the directly connected 4-pin and 8-pin of the delay pulse generator 282 and the directly connected 2-pin and 6-pin of delay pulse generator 282 is a 270,000 ohm, ½ watt, 5% tolerance resistor. The capacitor 328, connected between the directly connected 2-pin and 6-pin of delay pulse generator 282 and ground is a 1 microfarad capacitor rated at 25 volts. The resistor 330, connected between output terminal 298 of delay pulse generator 282 and ground is an 18,000 ohm, ¼ watt, 10% tolerance resistor, and capacitor 296 is a 0.01 microfarad capacitor rated at 25 volts.

The diode 332 having its anode connected to the LED supply terminal 182 of clock circuit 82, is an MR502 solid state diode, rated at 3 amperes.

The resistor 334 connected between the cathode of diode 332 and the anode of LED indicator 118 is a 2,000 ohm, ½ watt, 10% tolerance resistor.

Transistor 336, connected between LED indicator 118 and ground in FIG. 3, is a 2N3568 transistor. The resistor 338 which is connected from the base electrode of transistor 336 to ground is a 27,000 ohm, ¼ watt, 10% tolerance resistor. The resistor 340 which is connected between the base electrode of transistor 336 and the output terminal of NOR gate 284, is a 2,000 ohm, ¼ watt, 10% tolerance resistor.

The resistor 342 which is connected between 12 volt direct current supply line 250 and the 1-pin of time base generator 280 is an 18,000 ohm, ½ watt, 10% tolerance resistor.

The resistor 344 which is connected between 12 volt direct current supply line 250 and the common connection of pins 5, 6, 7 and 8 of time base generator 280 is an 18,000 ohm, ½ watt 10% tolerance resistor.

The resistor 346 which is connected between the 14-pin and the 15-pin of time base generator 280 is a 20,000 ohm, ¼ watt, 5% tolerance resistor.

The capacitor 348 which is connected between the 12-pin of time base generator 280 and ground is a 0.01 microfarad capacitor, rated at 25 volts.

The pulse rate setting network 350 connected between 12 volt direct current supply line 250 and ground and having an intermediate point connected to the 13-pin of time base generator 280, comprises a resistor 352, a capacitor 354, and a potentiometer 356. Resistor 352 is a 6.8 megohm, ½ watt, 5% tolerance resistor. Capacitor 354 is a 2 microfarad capacitor, rated at 25 volts. Potentiometer 356 is a 1 megohm potentiometer, which may, for instance, be a Spectrol No. 43P-105 potentiometer. In adjusting the device of the preferred embodiment for operation in a preferred mode the slider of potentiometer 356 is so set that when the device of the preferred embodiment is energized from a power line, and thus time base generator 280 is itself energized, the substantially rectangular output wave produced at the common connection of the 5, 6, 7 and 8-pins of the time base generator, on line 300, has a period of one hour, and the substantially rectangular voltage wave produced at pin 1 of time base generator 208 has a period of 30 seconds. In other words, potentiometer 356 is so set that a positive-going voltage transition capable of reducing the count in counter 238 by one is received at the 15-pin of counter 238 via counter chain pulsing line 300 once every hour.

The transistor 358 which is directly connected to LED indicator 122 is a 2N3568 transistor. The resistor 360 connected between the base of transistor 358 and ground is a 27,000 ohm, ¼ watt, 10% tolerance resistor. The resistor 362 which is connected between the base electrode of transistor 358 and the output terminal 310 (pin 6) of NOR gate 286 is a 2,000 ohm, ¼ watt, 10% tolerance resistor. The resistor 364 which is connected between 12 volt direct current supply line 250 and LED indicator 122 is a 2,000 ohm, ½ watt, 10% tolerance resistor.

The abovedescribed solenoid 58 (c.f., FIG. 1) is shown in schematic form in the lower, lefthand corner of FIG. 3. Solenoid 58 may be a Guardian No. 28 Inter 12 volt direct current solenoid, or a T8X9 Inter 12 volt direct current solenoid.

Referring now to delay pulse generator 290, at the bottom of FIG. 3, it will be seen that the 1-pin thereof is directly connected to ground, and that the 5-pin thereof is connected to ground through a capacitor 366. In the preferred embodiment of the present invention capacitor 366 is a 0.01 microfarad capacitor, rated at 25 volts. It will also be thereseen that the output of delay pulse generator 290, occurring on its 3-pin, provides a signal to the base of transistor 368, and that transistor 368 energizes solenoid 58 (also shown in FIG. 1). A bias voltage divider comprised of resistor 370 and 372 is interposed between the 3-pin of delay pulse generator 290 and transistor 368. In the preferred embodiment resistor 370 is a 470 ohm, ½ watt, 10% tolerance resistor; and resistor 372 is a 10,000 ohm, ½ watt, 10% tolerance resistor. As also seen in FIG. 2, a diode 374 is connected across the coil of solenoid 58. In the preferred embodiment diode 374 is a 1N4004 diode.

Returning to delay pulse generator 290, as shown in FIG. 3, it will be seen that its 4-pin and 8-pin are directly connected to 12 volt direct current supply line 250. It will also be seen that the 6-pin and the 7-pin are connected to supply line 250 through a resistor 376, and connected to ground through a capacitor 378. In the preferred embodiment resistor 376 is a 6.8 meghom, ½ watt, 5% tolerance resistor; and capacitor 378 is a 1 microfarad dielectric capacitor, rated at 25 volts. A resistor 380 is connected between the 2-pin of delay pulse generator 290 and supply line 250. Resistor 380, in the preferred embodiment, is an 18,000 ohm, ½ watt, 10% tolerance resistor. A capacitor 382 coacts with resistor 380 to provide a pulse shaping network. Capacitor 382, in the preferred embodiment, is a 0.001 microfarad capacitor rated at 50 volts.

Operation

The abovedescribed preferred embodiment of the present invention may be manipulated by the user thereof to carry out those modes of operation which are themselves characteristic features of the present invention as follows:

Setting the Delay Interval

In timelocks of the present invention, the magnitude of the delay interval between the arming of the timelock (followed by the closing of the associated vault door) and the earliest time at which the vault door can be reopened is retained in the bank's three thumbwheel switches found in each clock circuit, e.g., the bank of three thumbwheel switches 100, 102, 104 found in clock circuit 82 (FIG. 1).

The delay interval preset in any of the clock circuits 82, 84, 86 at any given time may be determined by reading the three digits indicated on the face of the digital thumbwheel switches of that clock circuit. The three digit number read from any switch bank of the device of the preferred embodiment of the present invention is equal to the duration in hours of the delay interval, then preset in the clock circuit which includes that switch bank. Thus, for instance, all three of the clock circuits 82, 84 and 86 shown in FIG. 1 are preset to a delay interval of 123 hours. The preset delay interval of 123 hours can be changed by the user to some other duration magnitude by manipulating the three thumbwheels of each switch bank, in the well known manner, until the number indicated on the face of each switch bank is equal to the numerical magnitude of the desired new delay interval in hours. The total range of delay interval magnitude values which can be preset on the switch banks of the device of the preferred embodiment of the present invention extends from 1 hour to 199 hours. As explained above, the mechanical structure of the lowest order thumbwheel switches of the clock circuit of the preferred embodiment is such that the switch bank of the clocks cannot be set to a zero delay, i.e., 000.

This mode of delay interval presetting is a particular feature of the present invention, not only because digital thumbwheel switches are far easier to read, especially in dim light, than the clock-work dials of the prior art, but also because the inadvertent setting of one of the clock circuits to too high a delay interval value can be instantly and easily corrected without waiting for the clock to progress through a complete delay interval, which is an unfortunate characteristic of most, if not all, prior art mechanical vault door timelocks. Indeed, devices embodying the present invention may be immediately reset to a different delay interval magnitude, or the delay interval magnitude retained in one misset clock circuit may be immediately reset, even after the timelock has been armed. This is easily accomplished in the device of the preferred embodiment, for example, by first thrusting arming knob 32*a* to the right (FIG. 1), to clear arming lever retaining pin 42 to escape from retaining notch 44, whereupon knob 32*a* and the forward end of arming lever 32 will rise under the urging of coil spring 40, thus closing time start switch 66 to ground. After thus disarming the timelock, the switch banks of the three clock circuits, individually, or any one which was inadvertently misset, are reset to the correct desired delay interval value by manipulation of the thumbwheel switches in the well known manner to cause the numerical value of the correct desired delay interval to appear on the face of the misset switch bank, or on the faces of all three switch banks if the timelock itself is being reset. Arming the timelock as described below will then cause the counter chains to commence counting down from the states corresponding to their correct desired switch bank settings.

Arming the Timelock

After all three clock circuits have been set to the desired delay interval, the timelock of the preferred embodiment may be armed by fully depressing arming knob 32*a*, which will remain in its depressed position due to the engagement of retaining pin 42 with notch 44 (FIG. 1). All three clock circuits will then simultaneously commence to "count down" in a manner analogous to the running down of the clock movements of conventional clock-work vault door timelocks.

Locking the Vault Door

After arming timelock 10 as just described, vault door 12 will be closed in the usual manner and its handwheel or other lock operating means manipulated to lock it. When the handwheel or other lock operating means is operated to drive home the bolt 18, in the usual manner, snubber pin 22 (FIG. 1) is withdrawn from vertical alignment with snubber bar 30, and snubber bar 30 is allowed to rise to the position shown in FIG. 1 under the urging of coil spring 40, in which position it blocks the retreat of snubber pin 22 into timelock housing 28, and thus prevents the bolt 18 from being withdrawn from their coacting recesses 20, preventing the reopening of vault door 12.

Unlocking the Vault Door

It will be seen from the above that once timelock 10 is armed and vault door 12 is closed and locked, and assuming that no one is trapped in the vault and manipulates arming knob 32*a* to release himself, vault door 12 cannot be unlocked and reopened until snubber bar 30 is allowed to drop down out of the horizontal retreat path of snubber pin 22. As may be seen from FIG. 1, however, snubber bar 30 is held in its snubber pin blocking position by arming lever 32 and coil spring 40. Clearly, then, the end of arming lever 32 remote from know 32*a* (the rear end as in FIG. 1) must drop before snubber bar 30 can drop and permit snubber pin 22 to retreat into housing 28 sufficiently to permit the unlocking and reopening of vault door 12. It will also be seen from FIG. 1 that, apart from manipulation of knob 32*a* by someone trapped in the vault, the rear end of arming lever 32 will only be allowed to drop (as urged by coil spring 40) when G-strip 48 is drawn to the right (in FIG. 1) by one of the solenoids 58, 60, 62 far enough to escape retaining pin 42 from notch 44. The circuit of the preferred embodiment of the present invention, as described above, operates to energize one of these solenoids only when its corresponding clock circuit has fully "counted down," which takes place only upon the elapse of the delay interval preset in the corresponding thumbwheel switch bank. In devices embodying the present invention, as in the prior art mechanical timelocks, all three clocks (clock circuits in the present invention) are set to the same delay interval magnitude, though they will not necessarily completely "count down" at the same instant, due to normal variations in the values of electrical components, etc. Thus, it will be seen that the first clock circuit to fully count down will energize its corresponding solenoid and thus release arming lever 32, causing snubber bar 30 to drop, and thus permitting the vault door 30 to be manually unlocked and reopened, at any desired time thereafter. Three clock circuits are provided in the device of the preferred embodiment of the present invention to guard against failure of a single circuit, just as three clock movements (two redundant) are provided in the mechanical vault timelock devices of the prior art. Once any one of the three clock circuits has fully counted down and energized its corresponding solenoid, thus escaping arming lever 32, and permitting the rear of snubber bar 30 to drop under the urging of coil spring 40, vault door 32 can be unlocked by manipulation of its associated combination dial, and reopened by means of its handwheel or other bolt operating means.

It is to be understood, however, that this invention may also be carried out by using two, or even only one, clock circuits, rather than three.

It will be seen that by the abovedescribed constructions, a timelock for bank vault doors or the like is provided which overcomes some of the major defects of the prior art clock-work timelock mechanisms, and possesses certain advantageous new features not possessed by the devices of the prior art.

It will thus be seen that the object set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

I claim:

1. A timelock for bank vault doors and the like comprising:

manually settable memory means settable to any one of a plurality of delay interval representing states;

timing pulse generating means for generating trains of timing pulses;

timing pulse train initiating means for initiating said trains of timing pulses; and counter means for counting a preset plurality of said timing pulses following the actuation of said initiating means, the magnitude of said preset plurality being determined by the state of said memory means when said initiating means is actuated, and the counting operation of said counter means being unaffected by resetting of said memory means during the counting of timing pulses by said counter means.

2. A timelock as claimed in claim 1 further comprising manually operable arming means for arming said timelock, said timing pulse train initiating means being actuated by said manually operable arming means.

3. A timelock as claimed in claim 2 further comprising disarming means for disarming said timelock, said disarming means being actuated by said counter means.

4. A timelock as claimed in claim 3 in which said memory means comprises three substantially duplicate memory means, said counter means comprises three substantially duplicate counter means, each associated with one of said three memory means, and said disarming means comprises three substantially duplicate portions, each of said three substantially duplicate portions of said disarming means being actuated by an output signal from an associated one of said counter means when said associated one of said counter means has completed the counting of a preset plurality of said timing pulses.

5. A timelock as claimed in claim 4 in which said arming means comprises manually operable lever means, said disarming means comprises a displaceable member, in addition to said duplicate portions, and any one of said duplicate portions when actuated by an output signal from its associated counter means displaces said displaceable member, thereby bringing about the disarming of the timelock.

6. A timelock as claimed in claim 5 in which said manually operable lever means is manually displaceable from an unoperated position to an operated position against biasing force exerted by resilient biasing means to arm the timelock, and the displacement of said displaceable member permits said manually operable lever means to return to said unoperated portion under the urging of said resilient biasing means.

7. A timelock as claimed in claim 1 in which said memory means remains in any state to which it is manually set until it is manually reset, and the state of said memory means is not altered by the operation of said counter means.

8. A timelock as claimed in claim 1 in which delay interval represented by the state of said memory means is indicated on the face of the timelock in decimal notation.

9. A timelock as claimed in claim 8 in which the delay interval indicated on the face of the timelock takes the form of a three-place decimal number corresponding to the magnitude of the delay interval in hours, and the digit occurring in each decimal place may be manually increased or decreased independently of the digits in the other two decimal places.

10. A timelock as claimed in claim 8 in which the numerals of said decimal notation are equal to or greater in size than the numerals of an elite typewriter type.

11. A timelock for bank vault doors and the like comprising:

manually settable memory means settable to any one of a plurality of delay interval states;

timing pulse generating means for generating trains of timing pulses;

manually operable timing pulse train initiating means for initiating said trains of timing pulses;

counter means for counting a preset plurality of said timing pulses following the actuation of said initiating means, the magnitude of said preset plurality being determined by the state of said memory means when said initiating means is actuated, and the counting operation of said counter means being recommenced for counting a different plurality of said timing pulses during the counting of a preset plurality of said timing pulses by first manually resetting said memory means to its state corresponding to said different plurality, and then manipulating said manually operable timing pulse train initiating means to initiate a new timing pulse train.

12. A timelock as claimed in claim 1 in which during the counting operation of said counter means the time which must elapse before the termination of the counting operation is continuously displayed on the face of the timelock in decimal notation.

13. A timelock as claimed in claim 12, further comprising power supply means for deriving operating power for the timelock from a power line and battery means charged from said power line for providing operating power for the timelock when the supply of power from said power line fails, the time which must elapse before the termination of any counting operation of said counter means being displayed on the face of the timelock when the timelock is powered from said power line, and not when the timelock is powered from said battery means.

14. A timelock as claimed in claim 1 in which said memory means is incapable of being set to a 000 state.

* * * * *